US005987276A

United States Patent [19]

Kumar et al.

[11] Patent Number: 5,987,276

[45] Date of Patent: Nov. 16, 1999

[54] CHARGING DEVICE HAVING A SHIELD WITH INTEGRAL ELECTRICAL CONNECTOR

[75] Inventors: Ajay Kumar, Fairport; Dhirendra C. Damji; Daniel A. Chiesa, both of Webster; Jerry W. Bryant, Rochester, all of N.Y.

[73] Assignee: Xerox Corporation, Stamford, Conn.

[21] Appl. No.: 08/971,015

[22] Filed: Nov. 14, 1997

[51] Int. Cl.[6] ..... G03G 15/00

[52] U.S. Cl. ..... 399/90; 250/324; 399/115; 399/172

[58] Field of Search ..... 399/90, 113, 115, 399/170–173; 250/324–326; 361/225

[56] References Cited

U.S. PATENT DOCUMENTS

| | | | |
|---|---|---|---|
| 4,533,230 | 8/1985 | Fletcher et al. | 399/173 |
| 4,585,320 | 4/1986 | Altavela et al. | 399/170 X |
| 4,585,321 | 4/1986 | Toshimitsu et al. | 399/172 X |
| 4,803,512 | 2/1989 | Ogura et al. | 399/170 |
| 5,028,779 | 7/1991 | Gundlach et al. | 250/325 |
| 5,051,781 | 9/1991 | Roehrs et al. | 399/60 |
| 5,216,465 | 6/1993 | Arai et al. | 399/90 |
| 5,602,712 | 2/1997 | Duifuku et al. | 361/225 |
| 5,666,605 | 9/1997 | Tokimatsu et al. | 399/173 |
| 5,742,874 | 4/1998 | Koshimura et al. | 399/173 X |

*Primary Examiner*—William J. Royer
*Attorney, Agent, or Firm*—John S. Wagley

[57] ABSTRACT

A charging apparatus for applying a uniform electrostatic charge to a charge retentive surface is provided. The charging apparatus is operably electrically connectable to a power supply for supplying an electrical bias to the charging apparatus. The apparatus includes a housing and an electrode mounted to the housing and positioned adjacent the surface in a non-contact relationship therewith. The apparatus also includes a shield connected to the housing and at least partially surrounding the electrode. The apparatus also includes an electrical connector, electrically connected to the shield and electrically connectable to the power supply for providing an electrical bias to the shield. The electrical connector extends from the shield and is integral therewith.

22 Claims, 12 Drawing Sheets

CHARGING DEVICE HAVING A SHIELD WITH INTEGRAL ELECTRICAL CONNECTOR

RELATED CASES

Cross reference is made to the following applications filed concurrently herewith: U.S. Pat. No. 5,845,179 entitled "Pin Charge Corotron With Optimum Dimensions For Minimum Ozone Production" by Dhirendra C. Damji et al., U.S. Pat. No. 5,822,654 entitled "Development Bias Connector With Integral Bearing Support" by Dhirendra C. Damji et al., U.S. patent. application Ser. No. 08/971,098 entitled "Charging Device Having An Electrode With Integral Electrical Connector" by Ajay Kumar et al., U.S. Pat. No. 5,890,035 entitled "Charging Device Module For Use With Print Cartridge" by Ajay Kumar et al., U.S. Pat. No. 5,835,823 entitled "Process Cartridge Including Process Components Having Critical Image Quality And Life-Extending Process Path Acting Regions" by Dhirendra C. Damji et al., U.S. Pat. No. 5,826,132 entitled "Variable Size, Replaceable Toner Sump Pans For Print Cartridges" by Dhirendra C. Damji et al., U.S. patent application Ser. No. 08/970,313 entitled "Molded Quick Change Photoreceptor Support" by Ajay Kumar et al., U.S. patent application Ser. No. 08/971,010 entitled "Printing Cartridge With Planar Drive Train" by Ajay Kumar et al., U.S. Pat. No. 5,784,671 entitled "Process Cartridge Including A Handle Defining Part Of A Machine Paper Path" by Dhirendra C. Damji et al., U.S. Pat. No. 5,809,377 entitled "Electrostatographic Process Cartridge Having A Non-Metallic Photoreceptor Grounding Pin " by Daniel A. Chiesa et al., U.S. Pat. No. 5,809,376 entitled "Limited Life Electrostatographic Process Cartridge Having A Waste Toner Electro-Sump Subassembly" by Daniel A. Chiesa et al., U.S. Pat. No. 5,832,345 entitled "Process Cartridge Having A Drive Assembly Resultant Force Counter-Acting Member" by Dhirendra C. Damji et al., U.S. Pat. No. 5,778,283 entitled "Process Cartridge Including A Banding Defect Preventing Waste Toner Moving Auger" by Dhirendra C. Damji et al., U.S. patent application Ser. No. 08/971,323 entitled "Process Cartridge Including A Developer Housing Defining Part Of A Machine Paper Path" by Dhirendra C. Damji et al., U.S. Pat. No. 5,778,284 entitled "All -In-One Process Cartridge Including A Photoreceptor And Process Components Having Relative Critical, Image Quality Acting Regions" by Dhirendra C. Damji et al., U.S. Pat. No. 5,881,341 entitled "Printing Cartridge With Molded Cantilever Developer Roller Spacing Spring" by Ajay Kumar et al., and U.S. patent application Ser. No. 08/970, 319 entitled "User Interface For An Electrostatographic Reproduction Machine" by Mark L. Leveto.

BACKGROUND

This invention relates to electrostatographic reproduction machines, and more particularly to an economical and capacity-extendible all-in-one process cartridge for easy adaptive use in a family of compact electrostatographic reproduction machines having different volume capacities and consumable life cycles. Specifically this invention relates to such a cartridge including a charging device having a shield with integral electrical connector.

Generally, the process of electrostatographic reproduction, as practiced in electrostatographic reproduction machines, includes charging a photoconductive member to a substantially uniform potential so as to sensitize the surface thereof. A charged portion of the photoconductive surface is exposed at an exposure station to a light image of an original document to be reproduced. Typically, an original document to be reproduced is placed in registration, either manually or by means of an automatic document handler, on a platen for such exposure.

Exposing an image of an original document as such at the exposure station, records an electrostatic latent image of the original image onto the photoconductive member. The recorded latent image is subsequently developed using a development apparatus by bringing a charged dry or liquid developer material into contact with the latent image. Two component and single component developer materials are commonly used. A typical two-component dry developer material has magnetic carrier granules with fusible toner particles adhering triobelectrically thereto. A single component dry developer material typically comprising toner particles only can also be used. The toner image formed by such development is subsequently transferred at a transfer station onto a copy sheet fed to such transfer station, and on which the toner particles image is then heated and permanently fused so as to form a "hardcopy" of the original image.

It is well known to provide a number of the elements and components, of an electrostatographic reproduction machine, in the form of a customer or user replaceable unit (CRU). Typically such units are each formed as a cartridge that can be inserted or removed from the machine frame by a customer or user. Reproduction machines such as copiers and printers ordinarily include consumable materials such as toner, volume limiting components such as a waste toner container, and life cycle limiting components such as a photoreceptor and a cleaning device. Because these elements of the copying machine or printer must be replaced frequently, they are more likely to be incorporated into a replaceable cartridge as above.

There are therefore various types and sizes of cartridges, varying from single machine element cartridges such as a toner cartridge, to all-in-one electrostatographic toner image forming and transfer process cartridges. The design, particularly of an all-in-one cartridge can be very costly and complicated by a need to optimize the life cycles of different elements, as well as to integrate all the included elements, while not undermining the image quality. This is particularly true for all-in-one process cartridges to be used in a family of compact electrostatographic reproduction machines having different volume capacities and elements having different life cycles.

There is therefore a need for a quality image producing, economical and capacity-extendible all-in-one process cartridge that is easily adapted for use in various machines in a family of compact electrostatographic reproduction machines having different volume capacities and elements with different life cycles.

Charging of a photoconductive surface in order to provide a charged surface from which a latent image is formed and later developed is an important step in the xerographic process. The charging process is typically accomplished by the use of an electrical device, either a contact or non-contact charged device. The contact charging device is typically in the form of a conformable roller which contacts the photoconductive surface. A non-contact charge device is typically in the form of an electrode which is spaced from the photoconductive surface and generates ions which form on the photoconductive surface. An electrical conductor is therefore necessary to transfer the power from a power source to the electrode.

Typically the electrical connectors are costly. Also, electrical conductors are fragile, difficult, expensive, and timely to assemble. Electrical connectors also may easily become faulty due to flaws in the durability of manufacturing processes. Further, quality problems in the components in manufacturing of electrical connectors cause the connectors to be a quality problem. Also, the electrical connectors are often inaccessible to the power supply requiring complicated and expensive wiring to transfer electricity from the power supply.

The following disclosures may be relevant to various aspects of the present invention:

U.S. Pat. No. 4,533,230

Patentee: Fletcher, et al.

Issue Date: Aug. 6, 1985

U.S. Pat. No. 4,585,320

Patentee: Altavela, et al.

Issue Date: Apr. 29, 1986

U.S. Pat. No. 4,803,512

Patentee: Ogura, et al.

Issue Date: Feb. 7, 1989

U.S. Pat. No. 5,051,781

Patentee: Roehrs, et al.

Issue Date: Sep. 24, 1991

U.S. Pat. No. 5,216,465

Patentee: Arai, et al.

Issue Date: Jun. 1, 1993

U.S. Pat. No. 5,602,712

Patentee: Daifuku, et al.

Issue Date: Feb. 11, 1997

U.S. Pat. No. 5,666,605

Patentee: Tokimatsu, et al.

Issue Date: Sep. 9,1997

U.S. Pat. No. 4,533,230 discloses a discharge apparatus for use in applying a charge to a charge retentive surface. The apparatus has an array of pin electrodes for charging the surface. The operation at higher current densities for shorter intervals achieves stable output at lower current levels.

U.S. Pat. No. 4,585,320 discloses a corona generating device for depositing charge. The device includes at least one elongated electrode and one element capable of adsorbing nitrogen oxide species generated. The element is plated with a thin layer of lead. The electrode includes a thin wire coated with a dielectric material. The device includes a shield plated with lead.

U.S. Pat. No. 4,803,512 discloses an image forming cartridge including a charger unit. Wire positioning members are provided at positions corresponding to holes in the charger unit. The members are spaced to ensure uniform charging.

U.S. Pat. No. 5,051,781 discloses an automatic xerographic set up and monitoring process for an electrostatographic machine with a corona charge intercept value obtained and used to optimally set corona charging levels for different modes.

U.S. Pat. No. 5,216,465 discloses a print cartridge including a primary static charger. The primary static charger has a grid which is contacted by a leaf spring to bias the charger toward the housing.

U.S. Pat. No. 5,602,712 discloses a photoconductive drum which is charged by placing a contact charger member in abutment with the object and applying a voltage. The charging is effected by properly controlling the capacitance of the charger member, the capacitance of the object and the applied voltage. A potential is achieved at low voltage while preventing ozone generation.

U.S. Pat. No. 5,666,605 discloses a corona discharging type charging device including saw tooth shaped electrodes. Side plates are placed on both sides of the electrodes and a control grid is applied with a DC voltage.

SUMMARY OF THE INVENTION

In accordance with one aspect of the present invention, there is provided a charging apparatus for applying a uniform electrostatic charge to a charge retentive surface. The charging apparatus is operably electrically connectable to a power supply for supplying an electrical bias to the charging apparatus. The apparatus includes a housing and an electrode mounted to the housing and positioned adjacent the surface in a non-contact relationship therewith. The apparatus also includes a shield connected to the housing and at least partially surrounding the electrode. The apparatus also includes an electrical connector, electrically connected to the shield and electrically connectable to the power supply for providing an electrical bias to the shield. The electrical connector extends from the shield and is integral therewith.

In accordance with another aspect of the present invention, there is provided a process cartridge for use in a printing machine. The process cartridge includes a charging apparatus for applying a uniform electrostatic charge to a charge retentive surface. The apparatus includes a housing and an electrode mounted to the housing and positioned adjacent the surface in a non-contact relationship therewith. The apparatus further includes an electrical connector and a shield connected to the housing and at least partially surrounding the electrode. The electrical connector is electrically connected to the shield and electrically connectable to the power supply for providing an electrical bias to the shield. The electrical connector extends from the shield and is integral therewith.

In accordance with yet another aspect of the present invention, there is provided an electrophotographic printing machine of the type including a process cartridge having a charging apparatus for applying a uniform electrostatic charge to a charge retentive surface. The apparatus includes a housing and an electrode mounted to the housing and positioned adjacent the surface in a non-contact relationship therewith. The apparatus further includes an electrical connector and a shield connected to the housing and at least partially surrounding the electrode. The electrical connector is electrically connected to the shield and electrically connectable to the power supply for providing an electrical bias to the shield. The electrical connector extends from the shield and is integral therewith.

BRIEF DESCRIPTION OF THE DRAWINGS

In the detailed description of the invention presented below, reference is made to the drawings, in which.

DETAILED DESCRIPTION OF THE INVENTION

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
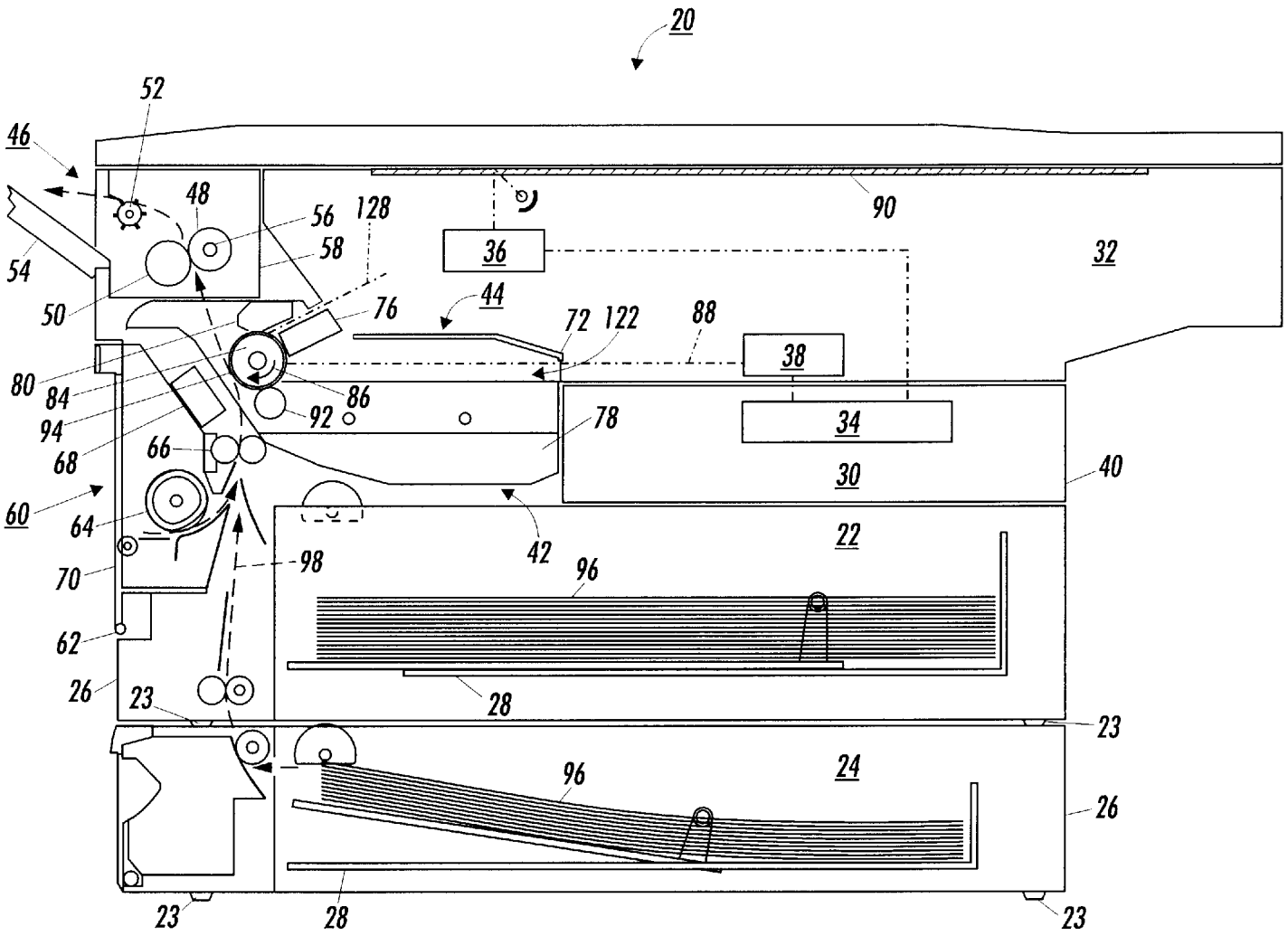
FIG. 1 is a front vertical illustration of an exemplary compact electrostatographic reproduction machine comprising separately framed mutually aligning modules in accordance with the present invention.
Figure 9:
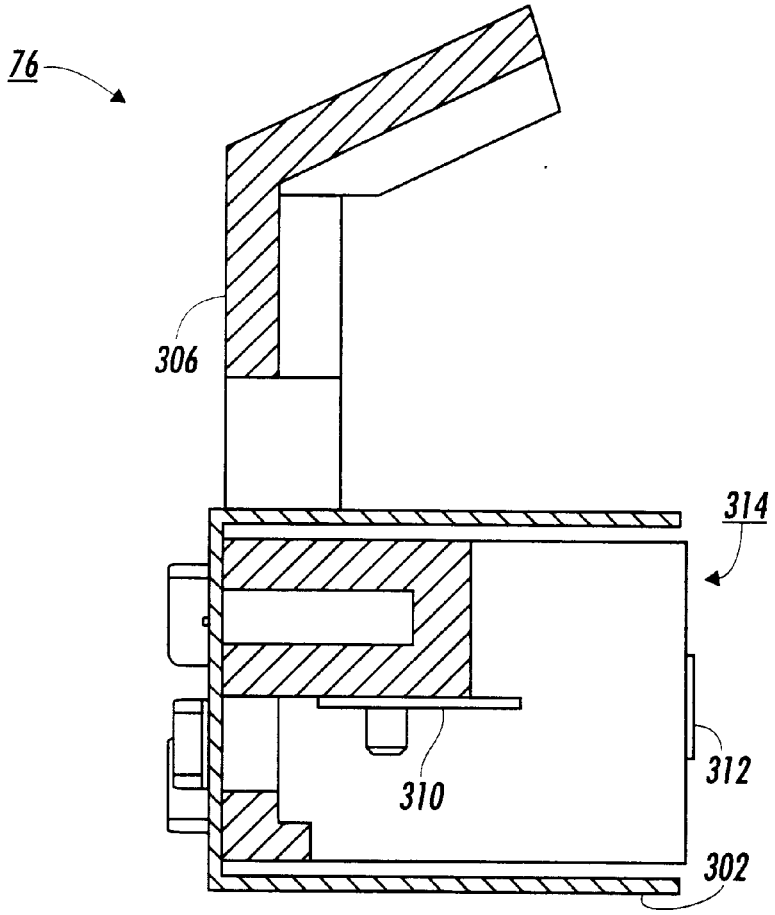
FIG. 9 is a cross sectional view of FIG. 7 along the line 9—9 in the direction of the arrows.

Referring now to FIGS. 1 and 9, there is illustrated a frameless exemplary compact electrostatographic reproduction machine 20 comprising separately framed mutually aligning modules according to the present invention. The compact machine 20 is frameless, meaning that it does not have a separate machine frame to which electrostatographic process subsystems are assembled, aligned to the frame, and then aligned relative to one another as is typically the case in conventional machines. Instead, the architecture of the compact machine 20 is comprised of a number of individually framed, and mutually aligning machine modules that variously include pre-aligned electrostatographic active process subsystems.

As shown, the frameless machine 20 comprises at least a framed copy sheet input module (CIM) 22. Preferably, the machine 20 comprises a pair of copy sheet input modules, a main or primary module, the CIM 22, and an auxiliary module the (ACIM) 24, each of which has a set of legs 23 that can support the machine 20 on a surface, therefore suitably enabling each CIM 22, ACIM 24 to form a base of the machine 20. As also shown, each copy sheet input module (CIM, ACIM) includes a module frame 26 and a copy sheet stacking and lifting cassette tray assembly 28 that is slidably movable in and out relative to the module frame 26. When as preferred here, the machine 20 includes two copy sheet input modules, the very base module is considered the auxiliary module (the ACIM), and the top module which mounts and mutually aligns against the base module is considered the primary module (the CIM).

The machine 20 next comprises a framed electronic control and power supply (ECS/PS) module 30, that as shown mounts onto, and is mutually aligned against the CIM 22 (which preferably is the top or only copy sheet input module). A framed latent image forming imager module 32 then mounts over and is mutually aligned against the ECS/PS module. The ECS/PS module 30 includes all controls and power supplies (not shown) for all the modules and processes of the machine 20. It also includes an image processing pipeline unit (IPP) 34 for managing and processing raw digitized images from a Raster Input Scanner (RIS) 36, and generating processed digitized images for a Raster Output Scanner (ROS) 38. The ECS/PS module 30 also includes harnessless interconnect boards and inter-module connectors (not shown), that provide all power and logic paths to the rest of the machine modules. An interconnect board (PWB) (not shown) connects the ECS controller and power supply boards (not shown) to the inter-module connectors, as well as locates all of the connectors to the other modules in such a manner that their mating connectors would automatically plug into the ECS/PS module during the final assembly of the machine 20. Importantly, the ECS/PS module 30 includes a module frame 40 to which the active components of the module as above are mounted, and which forms a covered portion of the machine 20, as well as locates, mutually aligns, and mounts to adjacent framed modules, such as the CIM 22 and the imager module 32.

The framed copy sheet input modules 22, 24, the ECS/PS module 30, and the imager module 32, as mounted above, define a cavity 42. The machine 20 importantly includes a customer replaceable, all-in-one CRU or process cartridge module 44 that is insertably and removably mounted within the cavity 42, and in which it is mutually aligned with, and operatively connected to, the framed CIM, ECS/PS and imager modules 22, 30, 32.

As further shown, the machine 20 includes a framed fuser module 46, that is mounted above the process cartridge module 44, as well as adjacent an end of the imager module 32. The fuser module 46 comprises a pair of fuser rolls 48, 50, and at least an exit roll 52 for moving an image carrying sheet through, and out of, the fuser module 46 into an output or exit tray 54. The fuser module also includes a heater lamp 56, temperature sensing means (not shown), paper path handling baffles(not shown), and a module frame 58 to which the active components of the module, as above, are mounted, and which forms a covered portion of the machine 20, as well as locates, mutually aligns, and mounts to adjacent framed modules, such as the imager module 32 and the process cartridge module 44.

The machine then includes an active component framed door module 60 that is mounted pivotably at pivot point 62 to an end of the CIM 22. The door module 60 as mounted, is pivotable from a substantially closed vertical position into an open near-horizontal position in order to provide access to the process cartridge module 44, as well as for jam clearance of jammed sheets being fed from the CIM 22. The door module 60 comprises active components including a bypass feeder assembly 64, sheet registration rolls 66, toner image transfer and detack devices 68, and the fused image output or exit tray 54. The door module 60 also includes drive coupling components and electrical connectors (not shown), and importantly, a module frame 70 to which the active components of the module as above are mounted, and which forms a covered portion of the machine 20, as well as, locates, mutually aligns, and mounts to adjacent framed modules, such as the CIM 22, the process cartridge module 44, and the fuser module 46.

More specifically, the machine 20 is a desktop digital copier, and each of the modules 22, 24, 30, 32, 44, 46, 60, is a high level assembly comprising a self-containing frame and active electrostatographic process components specified for sourcing, and enabled as a complete and shippable product. It is believed that some existing digital and light lens reproduction machines may contain selective electrostatographic modules that are partitioned for mounting to a machine frame, and in such a manner that they could be designed and manufactured by a supplier. However, there are no known such machines that have no separate machine frame but are comprised of framed modules that are each designed and supplied as self-standing, specable (i.e. separately specified with interface inputs and outputs), testable, and shippable module units, and that are specifically crafted and partitioned for enabling all of the critical electrostatographic functions upon a simple assembly. A unique advantage of the machine 20 of the present invention as such is that its self-standing, specable, testable, and shippable module units specifically allow for high level sourcing to a small set of module-specific skilled production suppliers. Such high level sourcing greatly optimizes the quality, the total cost, and the time of delivering of the final product, the machine 20.

Referring now to FIGS. 1–6, the CRU or process cartridge module 44 generally comprises a module housing subassembly 72, a photoreceptor subassembly 74, a charging subassembly 76, a developer subassembly 78 including a source of fresh developer material, a cleaning subassembly 80 for removing residual toner as waste toner from a surface of the photoreceptor, and a waste toner sump subassembly 82 for storing waste toner. The module housing subassembly 72 of the CRU or process cartridge module 44 importantly provides and includes supporting, locating and aligning structures, as well as driving components for the process cartridge module 44.

Still referring to FIG. 1, operation of an imaging cycle of the machine 20 using the all-in-one process cartridge module 44 generally, can be briefly described as follows. Initially, a photoreceptor in the form of a photoconductive drum 84 of the customer replaceable unit (CRU) or process cartridge module 44, rotating in the direction of the arrow 86, is charged by the charging subassembly 76. The charged portion of the drum is then transported to an imaging/exposing light 88 from the ROS 38 which forms a latent image on the drum 84, corresponding to an image of a document positioned on a platen 90, via the imager module 32. It will also be understood that the imager module 32 can easily be changed from a digital scanning module to a light lens imaging module.

The portion of the drum 84 bearing a latent image is then rotated to the developer subassembly 78 where the latent image is developed with developer material such as with charged single component magnetic toner using a magnetic developer roller 92 of the process cartridge module 44. The developed image on the drum 84 is then rotated to a near vertical transfer point 94 where the toner image is transferred to a copy sheet substrate 96 fed from the CIM 22 or ACIM 22 along a copy sheet or substrate path 98. In this case, the detack device 68 of the door module 60 is provided for charging the back of the copy sheet substrate (not shown) at the transfer point 94, in order to attract the charged toner image from the photoconductive drum 84 onto the copy sheet substrate.

The copy sheet substrate with the transferred toner image thereon, is then directed to the fuser module 46, where the heated fuser roll 48 and pressure roll 50 rotatably cooperate to heat, fuse and fix the toner image onto the copy sheet substrate. The copy sheet substrate then, as is well known, may be selectively transported to the output tray 54 or to another post-fusing operation.

The portion of the drum 84 from which the developed toner image was transferred is then advanced to the cleaning subassembly 80 where residual toner and residual charge on the drum 84 are removed therefrom. The imaging cycle of the machine 20 using the drum 84 can then be repeated for forming and transferring another toner image as the cleaned portion again comes under the charging subassembly 76.

The detailed and specific advantageous aspects of the structure and operation of the all-in-one CRU or process cartridge module 44, will now be described with particular reference to FIGS. 1 to 6. As shown, the all-in-one CRU or process cartridge module 44, generally includes six subassemblies comprising the module housing subassembly 72 (FIG. 2); the cleaning subassembly 80; the photoreceptor subassembly 74; the charging subassembly 76; the developer subassembly 78 (FIG. 3); and the waste toner sump subassembly 82. Generally, the function of the all-in-one CRU or process cartridge module 44 in the machine 20 is to electrostatically form a latent image, develop such latent image into a toner image through toner development, and transfer the toner image unfused onto a printing medium, such as a sheet of paper. The CRU or process cartridge module is left-side accessible to an operator facing the CIM 22 by opening the door module 60 (FIG. 1). Once the door module is opened, an operator or customer can remove or insert the CRU or process cartridge module 44 with one hand.

Figure 2:
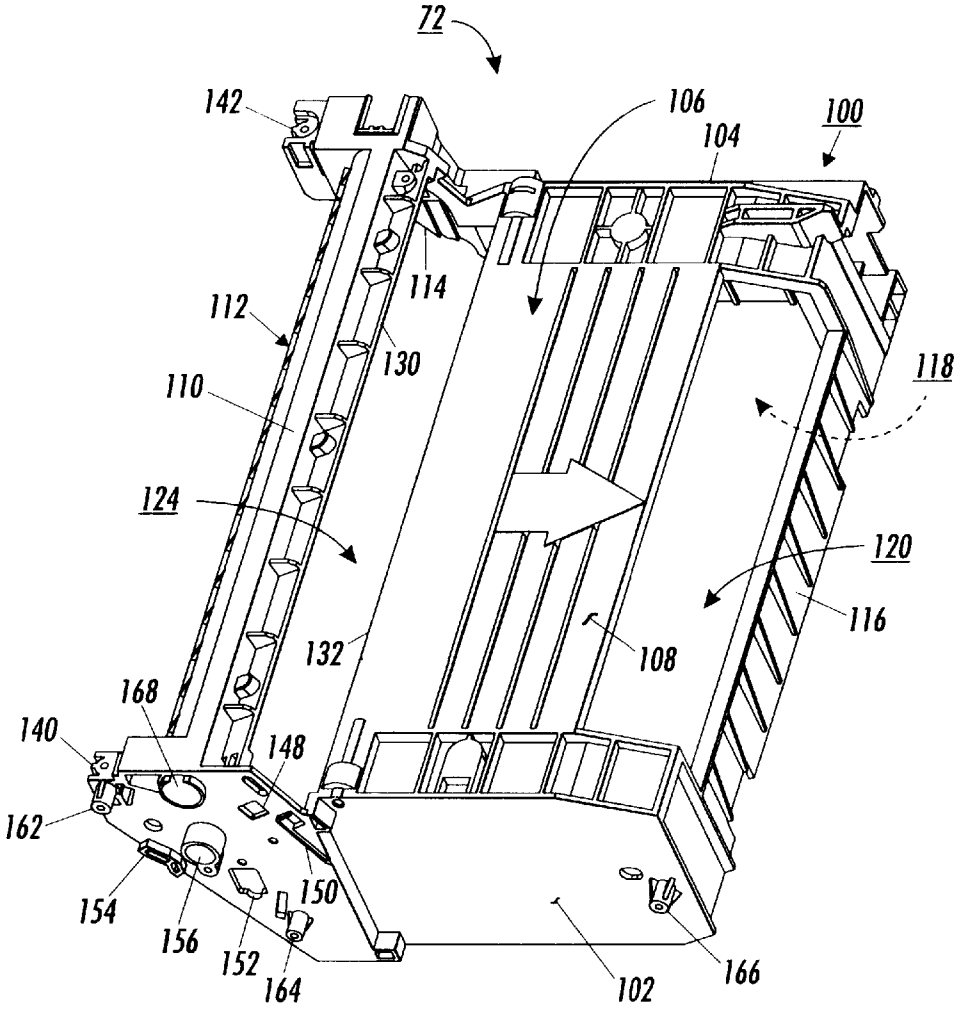
FIG. 2 is a top perspective view of the module housing of the CRU or process cartridge module of the machine of FIG. 1.
Figure 3:
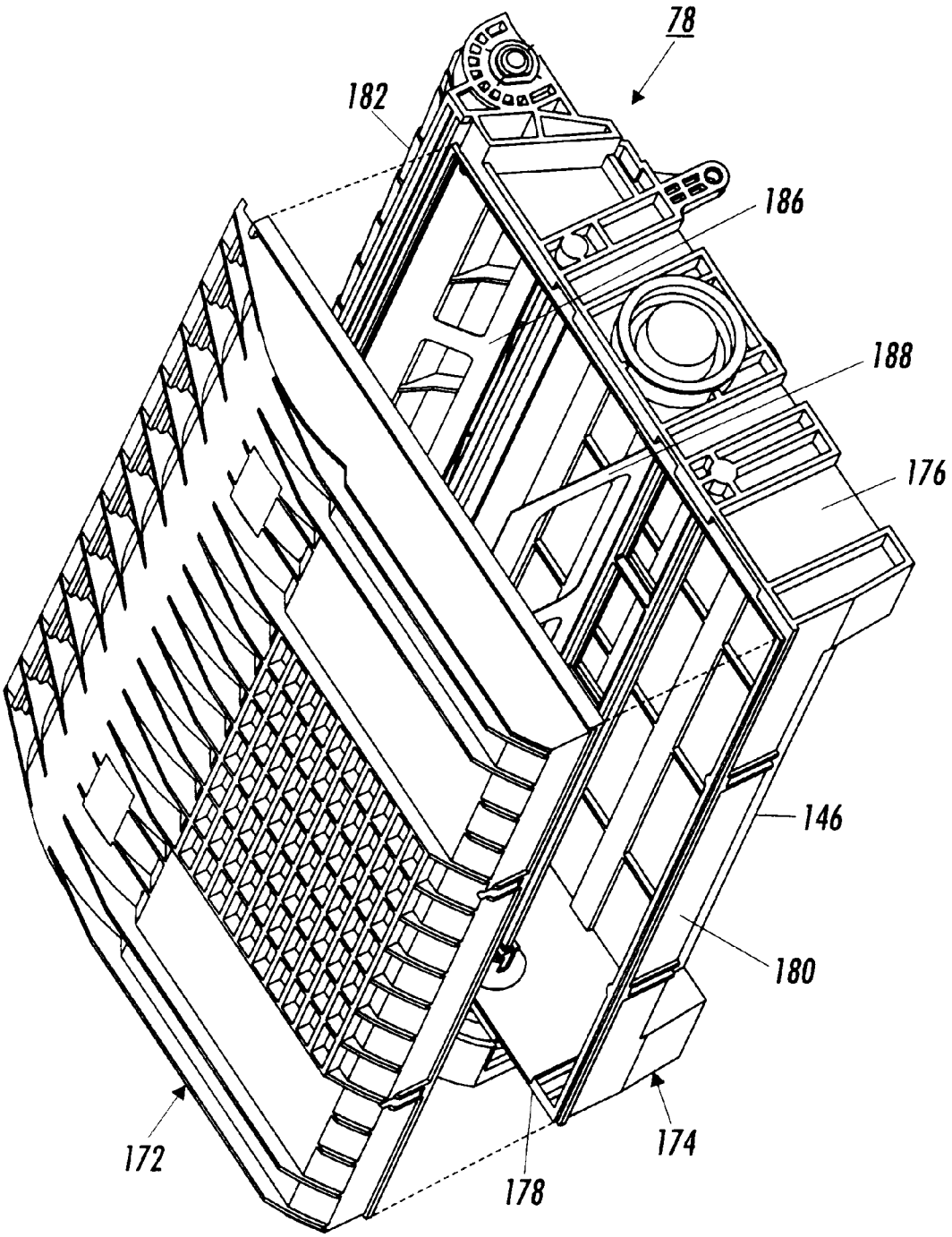
FIG. 3 is a bottom perspective view of the developer subassembly of the CRU or process cartridge module of the machine of FIG. 1 with the bottom of the developer housing unattached.

Referring now to FIGS. 1–6, the module housing subassembly 72 is illustrated (FIG. 2). As shown, it comprises a generally rectangular and inverted trough shaped module housing 100 having a first side wall 102, a second and opposite side wall 104, a top wall 106 including a substantially horizontal portion 108 and a nearly vertical portion 110 defining a raised rear end 112 (rear as considered relative to the process cartridge 44 being inserted into the cavity 42). There is no rear wall, thus resulting in an open rear end 114 for mounting the photoreceptor subassembly 74. The trough shaped module housing also includes a front end wall 116 that connects at an angle to the top wall 106. The trough shaped module housing 100 of course, has no bottom wall, and hence as inverted, it defines a trough region 118 that is wide open for assembling the developer subassembly 78 (FIG. 3). The top wall 106 and the front end wall 116 each include a first cutout 120 formed through their adjoining corner for partially defining a first light path 122 (FIG. 1) for the exposure light 88 from the ROS 38 of the imager module 32. The top wall 106 also includes a second cutout 124 formed thereinto at the adjoining angle between the horizontal portion 108 and near vertical portion 110 for mounting the charging subassembly 76 (FIG. 5), and for partially defining a second light path 126 (FIGS. 1 and 6) for an erase light 128 being focused into the photoreceptor area at the raised rear end 112 of the module housing 100.

Importantly, the module housing 100 includes two top wall cross-sectional surfaces 130, 132 defining the second cutout 124, and one top wall cross-sectional surface 130, of these cross-sectional wall surfaces, has a desired angle 134 (relative to the photoreceptor surface) for mounting and setting a cleaning blade 138 (FIG. 6) of the cleaning subassembly 80. Attachment members 140, 142 are provided at the raised rear end 112 and extending from the first and second side walls 102, 104 respectively, for attaching a module handle 144 to the module housing 100.

As pointed out above, the module housing 100 is the main structure of the all-in-one CRU or process cartridge module 44, and importantly supports all other subassemblies (cleaning subassembly 80, charging subassembly 76, developer subassembly 78, and sump subassembly 82) of the all-in-one process cartridge module 44. As such, it is designed for withstanding stresses due to various dynamic forces of the subassemblies, for example, for providing a required re-action force to the developer subassembly 78. Because it is located just about 3 mm below the fuser module 46, it is therefore made of a plastic material suitable for withstanding relatively high heat generated from the fuser module. Mounts (not shown) to the developer subassembly within the trough portion of the module housing subassembly are located such that the top wall 106 of the module housing defines a desired spacing comprising the first light path 122 between it and the top 146 of the developer subassembly. Similarly, the raised rear end 112 of the top wall 106 of the module housing is also such as to define a desired spacing between the charging subassembly 76 and the photoreceptor or drum 84, when both are mounted to the raised rear end 112 of the module housing 100. Additionally, the module housing 100 provides rigidity and support to the entire process cartridge module 44, and upon assembly mutually self-aligns the CRU or process cartridge module 44 relative to abutting modules such as the CIM 22, and ECS/PS module 30.

Figure 5:
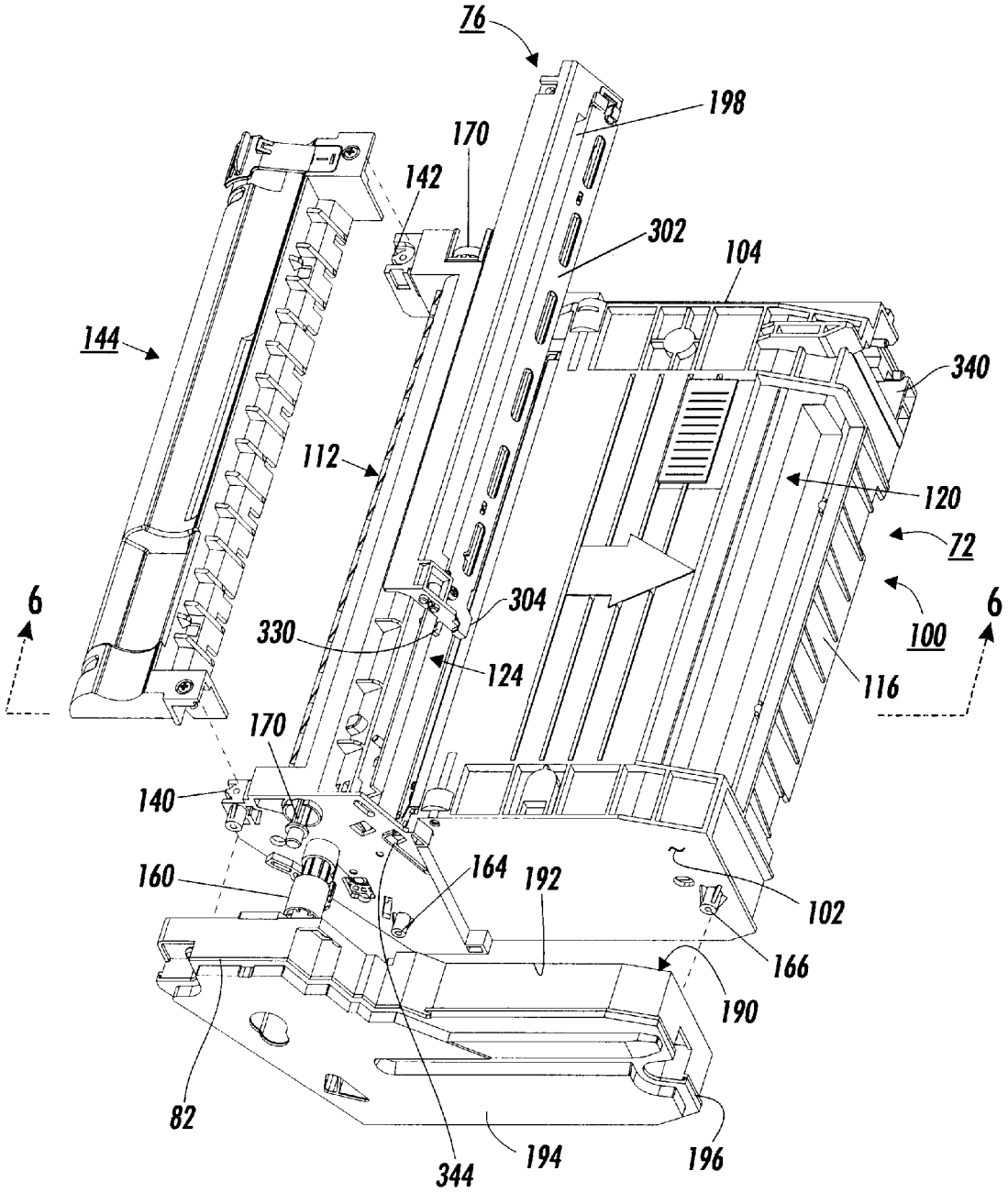
FIG. 5 is an exploded view of the various subassemblies of the CRU or process cartridge module of the machine of FIG. 1.

Referring in particular to FIG. 2, the first side wall 102 includes electrical connectors 148, 150 for supplying power from the ECS/PS module 30 (FIG. 1) via the sump subassembly 82 to the charging subassembly 76. It also includes an electrical connector 152 for supplying an electrical bias to the developer subassembly 78, as well as an alignment member 154 for aligning the detack device 68 (FIG. 1) to the photoreceptor. As also shown, the first side wall 102 further includes an apertured retainer device 156 for receiving an electrical grounding pin 160 for the photoreceptor 84. Importantly, the first side wall 102 further includes mounting members 162, 164, 166 for mounting the sump subassembly 82 to the module housing 100, and an opening for mounting an auger 170 of the cleaning subassembly 80 (FIGS. 1 and 5). The opening 168 also passes waste toner received from the photoreceptor 84 in the raised rear end 112, into the sump assembly 82, when mounted as above.

Referring now to FIG. 3, the developer subassembly 78 of the process cartridge module 44 is illustrated with an expandable bottom member 172 unattached in order to reveal the inside of the developer subassembly. As shown, the developer subassembly 78 comprises a generally rectangular developer housing 174 having the bottom member 172, the top 146, a first side 176, a second and opposite side 178, a front end 180 (relative to cartridge insertion), and a rear end 182. The developer housing 174 is for containing developer material, such as, single component magnetic toner (not shown), and it additionally houses the magnetic developer roll 92 (FIG. 1), a development bias application device 184, and a pair of developer material or toner agitators 186, 188.

Figure 4:
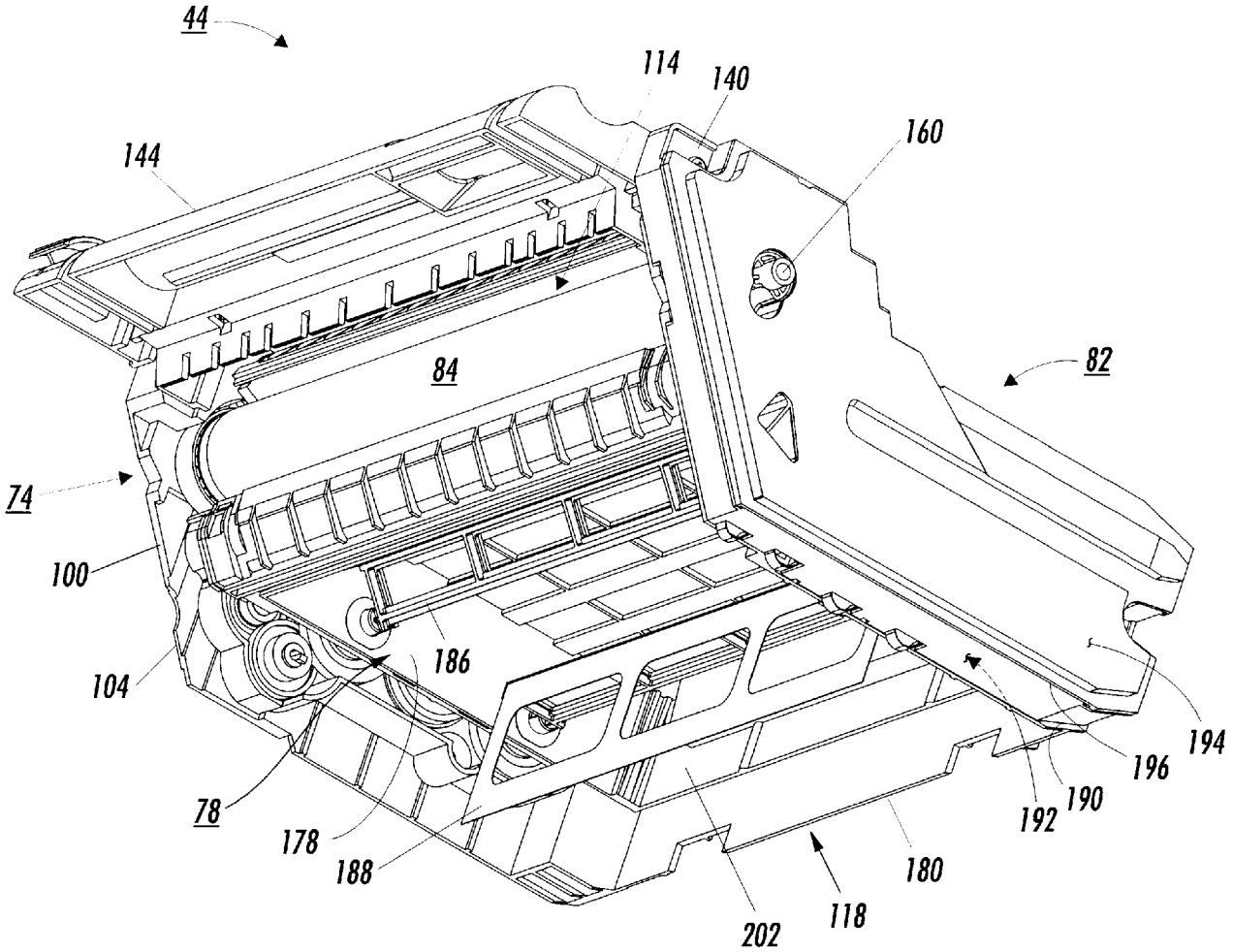
FIG. 4 is an open bottom perspective view of the CRU or process cartridge module of the machine of FIG. 1.

As shown in FIG. 4, the developer subassembly 78 is mounted to the module housing 100, and inside the trough region 118. With the bottom member 172 of the developer housing removed (for illustration purposes only), the agitators 186, 188 can clearly be seen. Also shown in FIG. 4 are the photoreceptor or drum 84 mounted within the raised rear end 112 of the module housing 100, as well as, the module handle 144 attached to the side walls 102, 104 at the raised rear end 112. The whole sump subassembly 82 is further shown with an outside surface 190 of its inside wall 192, mounted to the first side wall 102 of the module housing 100. The outside surface 194 of the outside wall 196 of the sump assembly is also clearly visible. The inside wall 192 and outside wall 196 partially define the sump cavity (not shown) for containing received waste toner, as above.

Referring now to FIG. 5, there is presented an exploded perspective view of the various subassemblies, as above, of the CRU or process cartridge module 44. As shown, the module handle 144 is attachable to mounting members 140, 142 at the raised rear end 112 of the module housing 100, and the sump subassembly 82 is mountable to the first side wall 102 of the cartridge housing. The developer subassembly 78 is mounted within the trough region 118 of the module housing 100, and is partially visible through the first cutout 120. Advantageously, the developer subassembly fits into the trough region 118 such that the top 146 (FIG. 3) of the developer subassembly and the inside of the top wall 106 of the module housing define the first light path 122 for the exposure light 88 from the ROS 38 (FIG. 1). As also shown, the charging subassembly 76 is mountable, at the second cutout 124, to the module housing 100, and includes a slit 198, through the charging subassembly, that defines part of the second light path 126 for the erase light 128 to pass to the photoreceptor 84.

Figure 6:
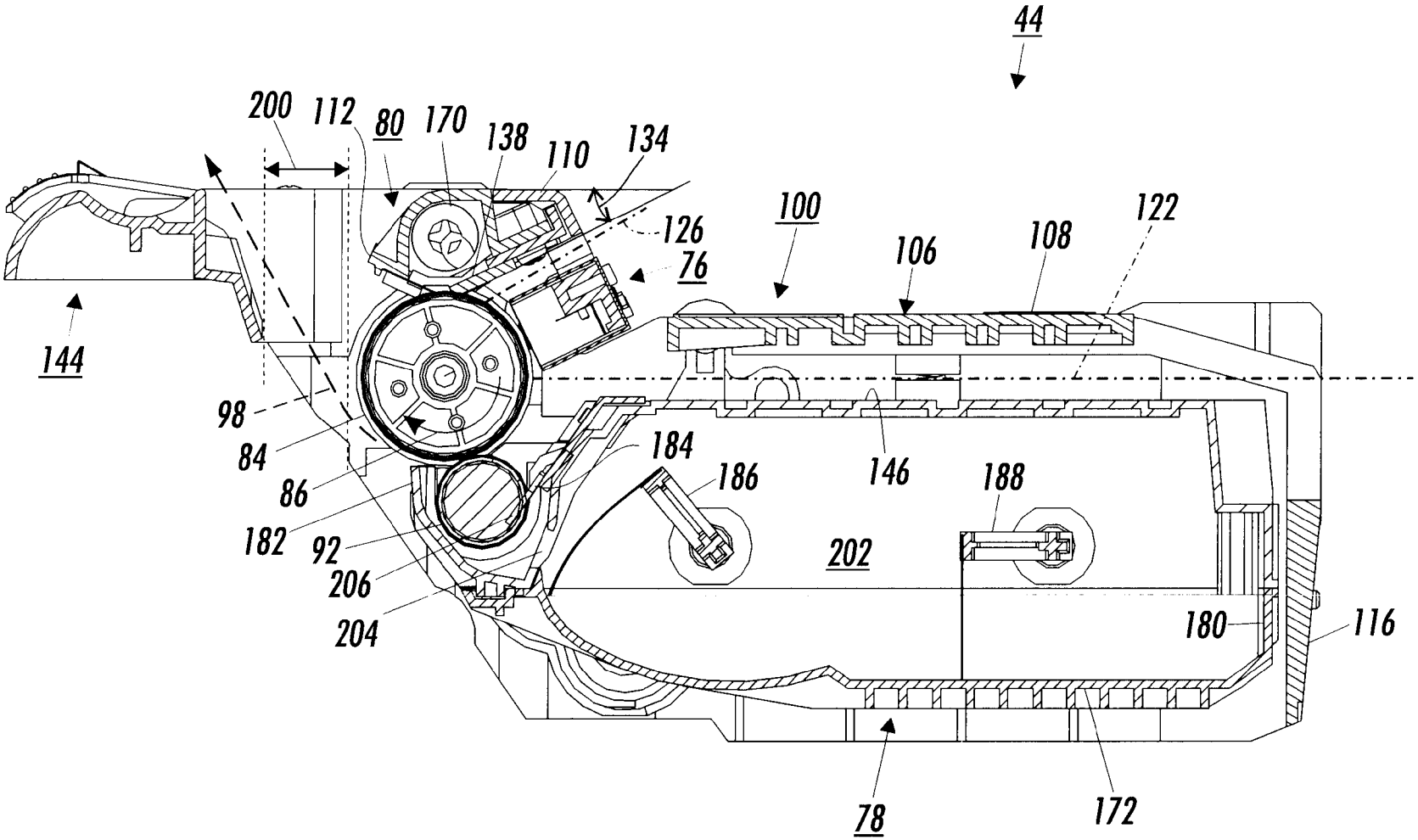
FIG. 6 is a vertical section (front-to-back) of the CRU or process cartridge module of the machine of FIG. 1.

Referring next to FIG. 6, a vertical (rear-to-back) section of the CRU or process cartridge module 44 as viewed along the plane 6—6 of FIG. 5 is illustrated. As shown, the developer subassembly 78 is mounted within the trough region 118 of the module housing subassembly 72 as defined in part by the front end wall 116, the second side wall 104, and the top wall 106 of the module housing subassembly. The module handle 144 as attached to mounting members 140, 142, (only one of which is visible), forms a portion of the sheet or paper path 98 of the machine 20 (FIG. 1) by being spaced a distance 200 from photoreceptor 84 in the raised rear end 112 of the module housing 100. The photoreceptor or drum 84 is mounted to the side walls 102, 104, (only one of which is visible), and as shown is located within the raised rear end 112 and is rotatable in the direction of the arrow 86. The charging subassembly 76 is mounted within the second cutout 124 in the top wall 106 and includes the slit 198 defining part of the second light path 126 for erase light 128 to pass to the photoreceptor 84. Upstream of the charging subassembly 76, the cleaning subassembly 80, including the cleaning blade 138 and the waste toner removing auger 170, is mounted within the raised rear end 112, and into cleaning contact with the photoreceptor 84. As further shown, the top wall 106 of the module housing 100 is spaced from the top 146 of the developer subassembly 78, thus defining the part of first light path 122 for the exposure light 88 from the ROS 38 (FIG. 1). The first light path 122 is located so as to be incident onto the photoreceptor at a point downstream of the charging subassembly 76.

The front 180, top 146, and bottom member 172 of the developer subassembly define a chamber 202, having an opening 204, for containing developer material (not shown). The first and second agitators 186, 188 are shown within the chamber 202 for mixing and moving developer material towards the opening 204. The development bias application device 184 and a charge trim and metering blade 206 are mounted at the opening 204. As also shown, the magnetic developer roll 92 is mounted at the opening 204 for receiving charged and metered developer material from such opening, and for transporting such developer material into a development relationship with the photoreceptor 84.

According to the present invention and referring to FIG. 5, a charging subassembly 76 is shown having a shield 302 with an integral electrical connector 304.

Figure 7:
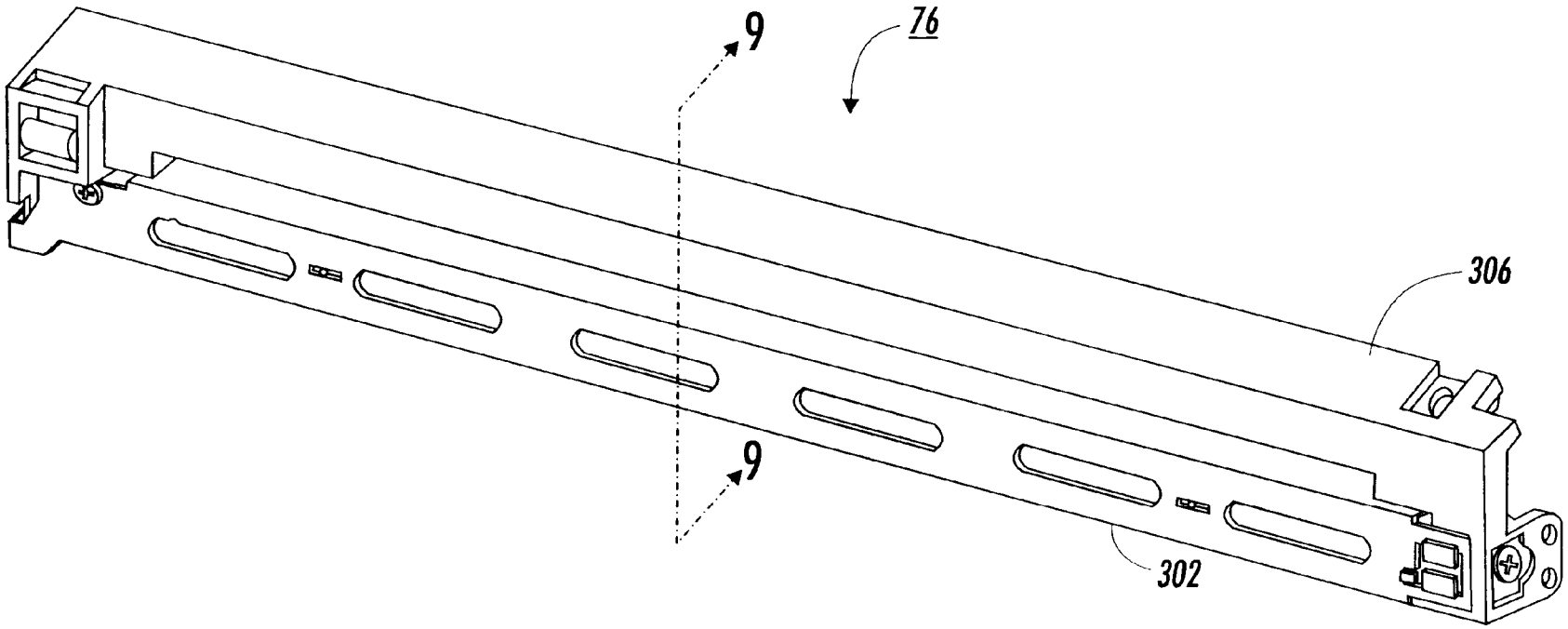
FIG. 7 is a perspective view of a charging device having a shield with integral electrical connector according to the present invention.

Referring now to FIG. 7, the charging subassembly 76 is shown in greater detail. The charging subassembly 76 includes housing 306 from which the shield 302 is supported. The housing 306 may be made of any suitable durable material which is electrically insulative and capable of withstanding the high voltages required for a charging device. For example, the housing 306 may be made of a polycarbonate material with glass fillers. Other suitable materials include Noryl™ a trademark of GE Plastics Ltd.

It should be appreciated that the present invention may be practiced with any charging device requiring a shield which is to receive an electrical bias. For example, the invention may be practiced where the charging device is a corotron, scorotron, or any other charging device including an electrode which is spaced from the photoconductive surface.

Figure 8:
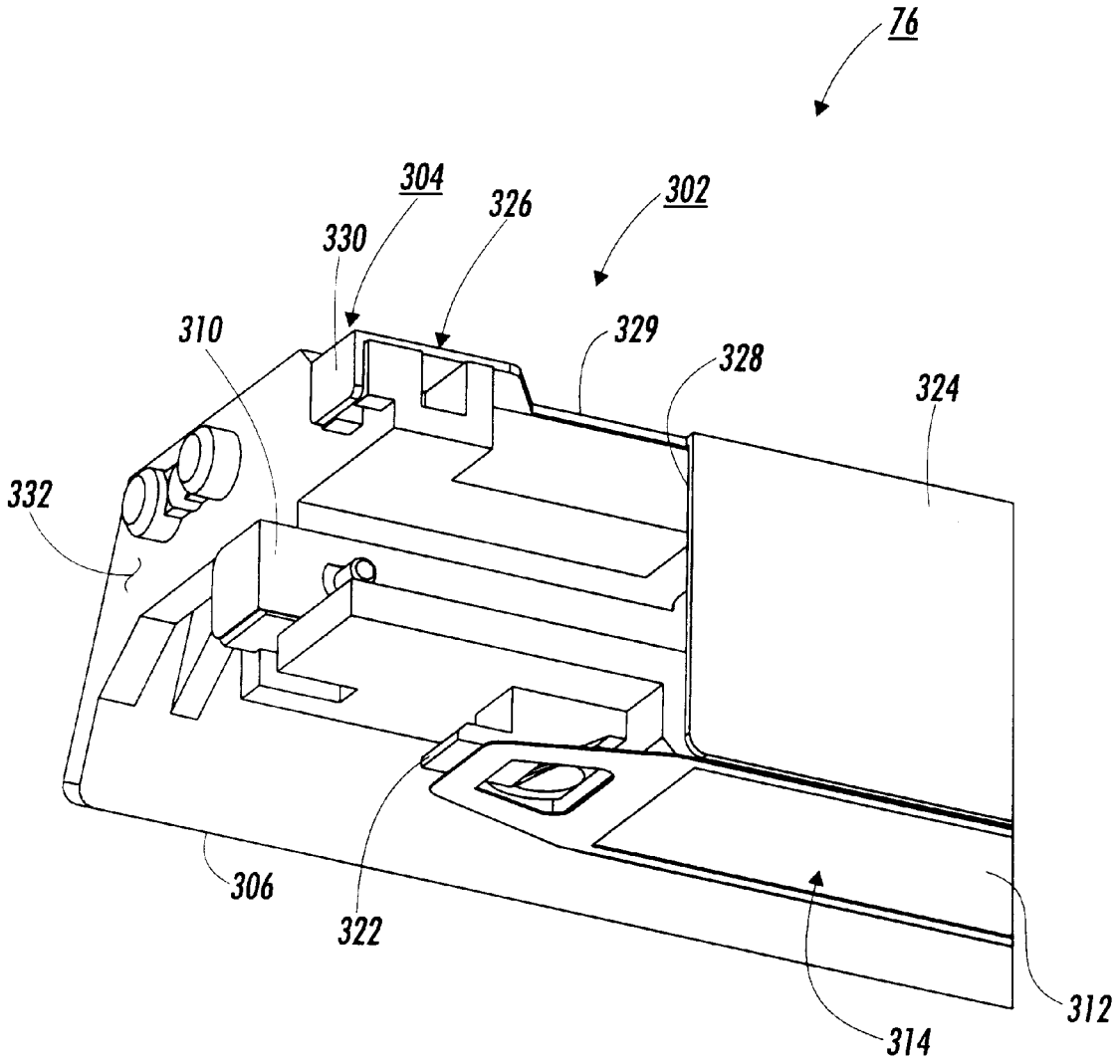
FIG. 8 is a partial perspective view of the charging device of FIG. 7.

Referring now to FIG. 8, the charging subassembly 76 is shown in greater detail. The charging subassembly 76 includes an electrode 310 mounted to the housing 306 and position spaced from the shield 302. The electrode 310 may have any suitable shape and may be, for example, in the form of a bare wire or a glass coated wire. As shown in FIG. 8, the electrode 310 is in the form of a pin type corotron electrode. Shield 302 is spaced from and surrounds electrode 310.

The electrode 310 and the shield 302 are made of any suitable durable electrically conductive material that is able to withstand the high voltages and high ozone levels of the charging subassembly 76. For example, the shield 302 and the electrode 310 are made of stainless steel.

Referring now to FIG. 9, the shield 302 is shown in greater detail. The shield 302 surrounds the electrode 310 on 3 sides thereof. A grid 312 is positioned over opening 314 formed from the U shaped shield 302.

Figure 10:
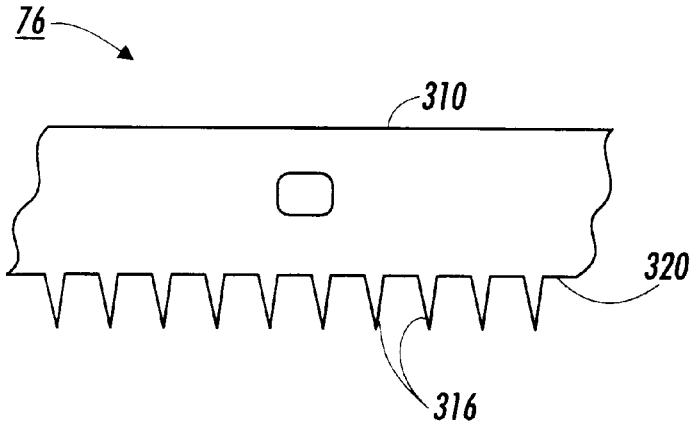
FIG. 10 is a partial plan view of an electrode for use with the charging device of FIG. 7.

Referring now to FIG. 10, the electrode 310 is shown in greater detail. The electrode 310 is formed from a generally planar sheet and includes a series of pin electrodes 316 extending from edge 320 of the electrode 310.

Referring again to FIG. 8, the grid 312 may be made of any suitable durable electrically conductive material capable of withstanding the high ozone environment around a charging device. For example, the grid 312 may be made of stainless steel. The grid 312 may thus be etched from a thin sheet of stainless steel. The grid 312 is positioned over the opening 314 of the shield 302 and is supported at opposed ends of the charging subassembly 76 by clips 322.

The clips 322 may be made of any suitable durable material and at least one of the clips 322 may be made of an electrically conductive material such that the clip 322 provides an electrical path for the electrical connection of the grid 312 to, for example the shield 302. Alternatively, a metal connector perhaps in the form of a helical spring may be used to interconnect the grid 312 to the shield 302.

The shield 302 includes a generally U shaped portion 324 as well as a connector portion 326 extending from a first end 328 of the U shaped portion 324. The electrical connector 304 is formed from the connector portion 326 of the shield 302.

The connector portion 326 of the shield may have any suitable shape capable of electrically connecting the shield 302. For example, as shown in FIG. 8, the connector portion 326 of the shield 302 may include a flat or planar portion 329 extending from the shield portion 324 and connector portion 330 extending perpendicularly from the planar portion 329 and positioned beyond end 332 of the charging subassembly 76.

Figure 12:
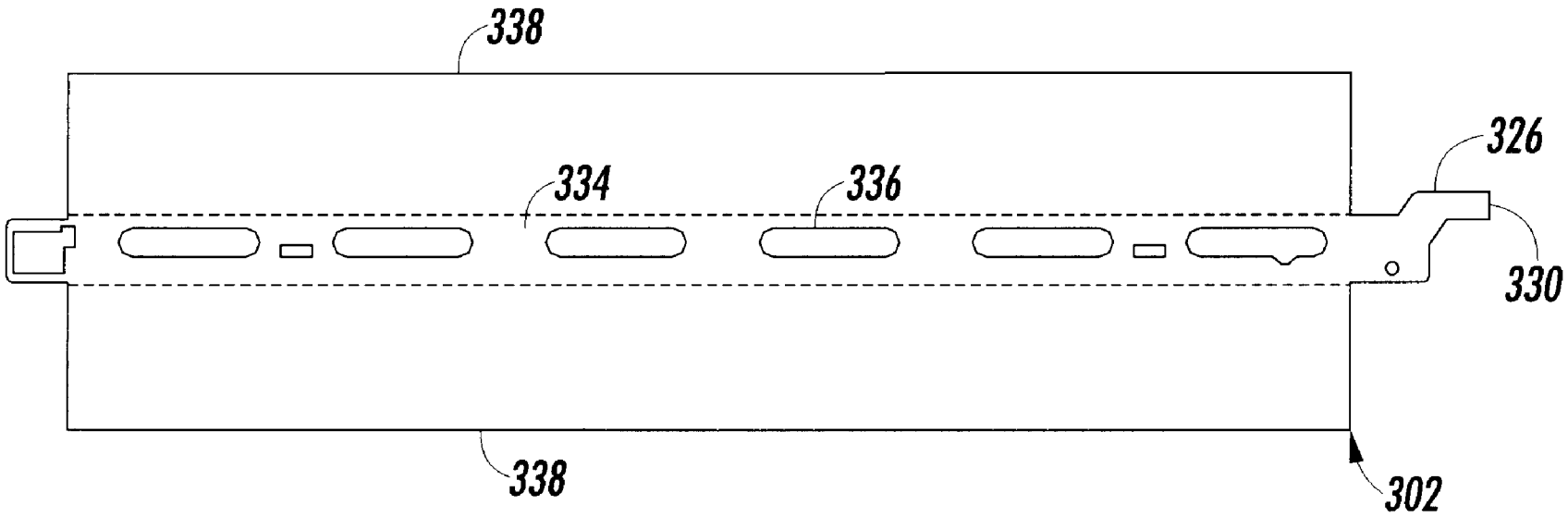
FIG. 12 is a plan view of the shield for use with the charging device of FIG. 7 showing the shield as a flat sheet prior to being bent into its usable shape.

Referring now to FIG. 12, the shield 302 is shown as a flat sheet of stainless steel before it is bent into the U shaped shield. The central portion 334 of the shield 302 may include apertures 336, the end side portions 338 of the shield extend perpendicularly from the portion 334 and are thus folded into position. The electrical connection portion 326 extends outwardly from the U shaped portion and includes a portion which is bent into the connector portion 330.

Referring again to FIG. 5, upon installation of the charging subassembly 76 into housing 340 of the process cartridge 72, the connector portion contact 330 is positioned through shield connector opening 344 in the housing 340 such that the shield connector 330 passes through the shield connector opening 344.

Figure 11:
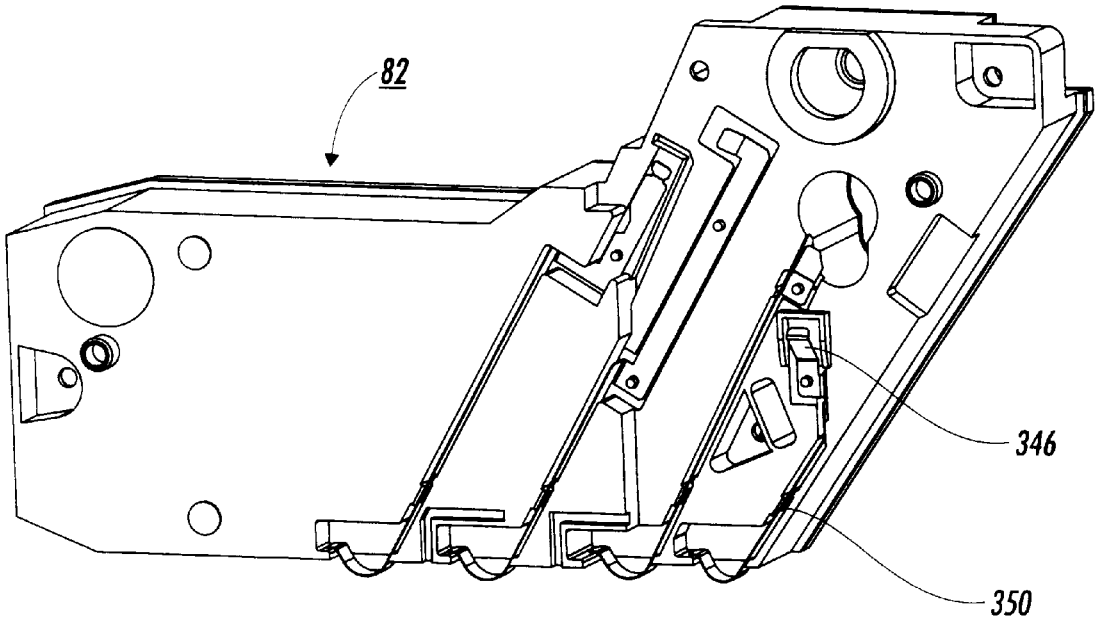
FIG. 11 is a perspective view of a waste toner sump for the process cartridge of FIG. 2 showing the electrical lead for cooperating with the electrode with integral electrical connector.

Referring now to FIG. 11, the connector portions 330 contacts connector 346 on the electrical lead 350 of toner sump housing 82. The electrical lead 350 provides an electrical path from the connector portion 330 to the power supply board (not shown). Thus, the shield 302 of the charging subassembly 76 is electrically connected to the power supply as the charging subassembly 76 is installed into the process cartridge 72.

Figure 13:
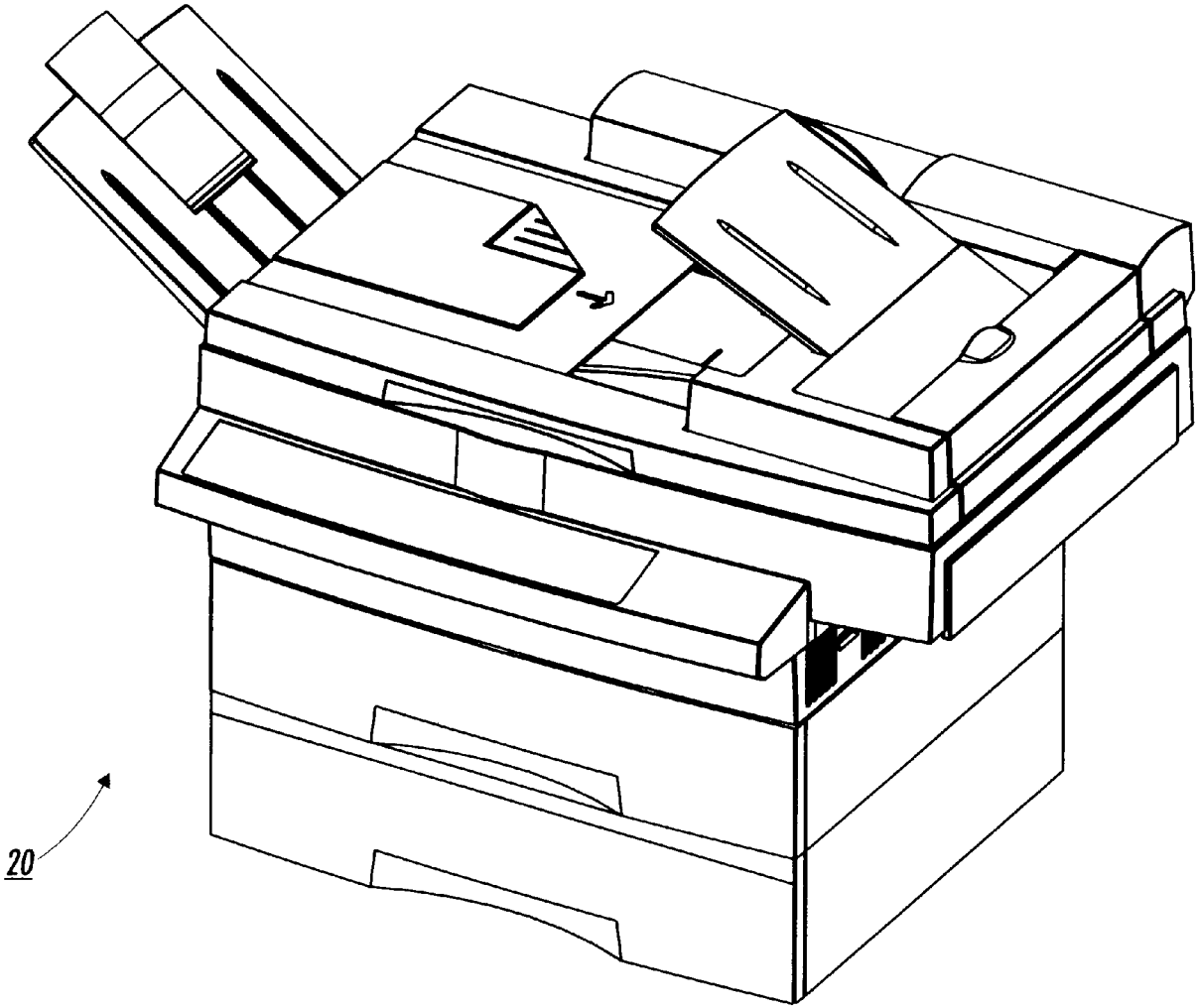
FIG. 13 is a perspective view of the machine of FIG. 1.

Referring now to FIG. 13, a printing machine 20 is shown which may utilize the charging device with integral shield connector.

By providing a charging device, providing a shield with an integral connector, the expensive connector required for this shield is eliminated.

By providing a charging device having a shield with an integral connector, time consuming and integral assembly of the shield to a connector is eliminated.

By providing a charging device having a shield with an integral connector, a solid, trouble free electrical connection is provided.

By providing a charging device having a shield with an integral connector, a solid, high quality electrical connection may be provided.

By providing a charging device having a shield with an integral connector extending from one end of a charging device, the electrical connection may be readily accessible to a power supply.

While this invention has been described in conjunction with various embodiments, it is evident that many alternatives, modifications, and variations will be apparent to those skilled in the art. Accordingly, it is intended to embrace all such alternatives, modifications, and variations as fall within the spirit and broad scope of the appended claims.

What is claimed is:

1. A charging apparatus for applying a uniform electrostatic charge to a charge retentive surface, said charging apparatus operably electrically connectable to a power supply for supplying an electrical bias to said charging apparatus, said apparatus comprising:

a housing;

an electrode mounted to said housing and positioned adjacent said surface in a non-contact relationship therewith;

a shield connected to said housing and at least partially surrounding said electrode; and an electrical connector, electrically connected to said shield and electrically connectable to the power supply for providing an electrical bias to said shield, said electrical connector extending from said shield and integral therewith, said electrical connector and said shield having a one-piece construction.

2. A charging apparatus according to claim 1, wherein said electrode comprises an array of pin electrodes supported by said housing and positioned adjacent said surface in a non-contact relationship.

3. A charging apparatus according to claim 1, wherein said shield comprises a generally U shaped shield connected to said housing.

4. A charging apparatus according to claim 2, further comprising a grid positioned across distal ends of said shield.

5. A charging apparatus according to claim 1:

wherein said charging apparatus comprises a module adapted to be insertable into a process cartridge; and wherein said electrical connector is engagable with the power supply as said charging apparatus is inserted into the process cartridge.

6. A charging apparatus according to claim 1, wherein said shield comprises a portion thereof extending from one end thereof, said portion defining said electrical connector.

7. A charging apparatus according to claim 6:

wherein said housing comprises a portion thereof extending from one end thereof; and wherein said portion of said shield is supported by said portion of said housing.

8. A charging apparatus for applying a uniform electrostatic charge to a charge retentive surface, said charging apparatus operably electrically connectable to a power supply for supplying an electrical bias to said charging apparatus, said apparatus comprising:

a housing;

an electrode mounted to said housing and positioned adjacent said surface in a non-contact relationship therewith;

a shield connected to said housing and at least partially surrounding said electrode; and an electrical connector, electrically connected to said shield and electrically connectable to the power supply for providing an electrical bias to said shield, said electrical connector extending from said shield and integral therewith, said shield including a portion thereof extending from one end thereof, said portion defining said electrical connector, said electrical connector having a first planar portion extending coplanarly from the shield and a second planar portion extending perpendicularly from the distal end of said first planar portion.

9. A process cartridge for use in a printing machine comprising, said process cartridge including a charging apparatus electrically connectable to a power supply for applying a uniform electrostatic charge to a charge retentive surface, said apparatus comprising:

a housing;

an electrode mounted to said housing and positioned adjacent said surface in a non-contact relationship therewith;

a shield connected to said housing and at least partially surrounding said electrode; and an electrical connector, electrically connected to said shield and electrically connectable to the power supply for providing an electrical bias to said shield, said electrical connector extending from said shield and integral therewith, said electrical connector and said shield having a one-piece construction.

10. A process cartridge according to claim 9, wherein said electrode comprises an array of pin electrodes supported by said housing and positioned adjacent said surface in a non-contact relationship.

11. A process cartridge according to claim 9, wherein said shield comprises a generally U shaped shield connected to said housing.

12. A process cartridge according to claim 10, further comprising a grid positioned across distal ends of said shield.

13. A process cartridge according to claim 9:

wherein said charging apparatus comprises a module adapted to be insertable into the process cartridge; and wherein said electrical connector is engagable with the power supply as said charging apparatus is inserted into the process cartridge.

14. A process cartridge according to claim 9, wherein said shield comprises a portion thereof extending from one end thereof, said portion defining said electrical connector.

15. A process cartridge according to claim 9:

wherein said housing comprises a portion thereof extending from one end thereof; and wherein said portion of said shield is supported by said portion of said housing.

16. An electrophotographic printing machine of the type including a process cartridge having a charging apparatus electrically connectable to a power supply for applying a uniform electrostatic charge to a charge retentive surface, said apparatus comprising:

a housing;

an electrode mounted to said housing and positioned adjacent said surface in a non-contact relationship therewith;

a shield connected to said housing and at least partially surrounding said electrode; and an electrical connector, electrically connected to said shield and electrically connectable to the power supply for providing an electrical bias to said shield, said electrical connector extending from said shield and integral therewith, said electrical connector and said shield having a one-piece construction.

17. A printing machine according to claim 16, wherein said electrode comprises an array of pin electrodes supported by said housing and positioned adjacent said surface in a non-contact relationship.

18. A printing machine according to claim 16, wherein said shield comprises a generally U shaped shield connected to said housing.

19. A printing machine according to claim 16, further comprising a grid positioned across distal ends of said shield.

20. A printing machine according to claim 16:

wherein said charging apparatus comprises a module adapted to be insertable into the process cartridge; and wherein said electrical connector is engagable with the power supply as said charging apparatus is inserted into the process cartridge.

21. A printing machine according to claim 16, wherein said shield comprises a portion thereof extending from one end thereof, said portion defining said electrical connector.

22. A printing machine according to claim 16:

wherein said housing comprises a portion thereof extending from one end thereof; and wherein said portion of said shield is supported by said portion of said housing.

* * * * *